United States Patent [19]

Macris

[11] Patent Number: 4,925,039

[45] Date of Patent: May 15, 1990

[54] PORTABLE FOLDING CRANE

[76] Inventor: James Macris, 67 Horne St., Dover, N.H. 03820

[21] Appl. No.: 272,730

[22] Filed: Nov. 18, 1988

[51] Int. Cl.[5] ..... B66C 23/48

[52] U.S. Cl. ..... 212/182; 212/189; 212/261; 212/265

[58] Field of Search ..... 212/182, 189, 244, 254, 212/265, 261, 263, 187, 222; 254/4 R, 4 B, 8 R, 8 B; 414/680

[56] References Cited

U.S. PATENT DOCUMENTS

| | | | |
|---|---|---|---|
| 2,706,120 | 4/1955 | Stratton | 212/189 |
| 3,145,857 | 8/1964 | Hayman et al. | 212/261 |
| 3,275,296 | 9/1966 | Meyer | 212/265 |
| 3,367,512 | 2/1968 | Kaplan | 414/680 |
| 4,144,973 | 3/1979 | Reale | 212/261 |
| 4,508,233 | 4/1985 | Helm | 212/182 |
| 4,770,304 | 9/1988 | Woods | 212/189 |

FOREIGN PATENT DOCUMENTS

| | | | |
|---|---|---|---|
| 463743 | 11/1968 | Switzerland | 212/261 |

*Primary Examiner*—Sherman D. Basinger
*Assistant Examiner*—Thomas J. Brahan
*Attorney, Agent, or Firm*—Robert S. Smith

[57] ABSTRACT

A portable folding crane which includes an elongated base member having first and second axial extremities and first and second elongated telescoping legs. Each of the legs has first and second axial extremities and each of the first axial extremities is pivotally connected proximate to respective axial extremities of the base member. A telescoping column member has first and second axial extremities and the first axial extremity of the telescoping column member is pivotally connected to the base member. A boom member has first and second axial extremities and the second axially extremity of the telescoping column member being the first axial extremity of the boom member are pivotally connected. Apparatus for urging the boom member to pivot with respect to the column member is also provided.

4 Claims, 4 Drawing Sheets

PORTABLE FOLDING CRANE

BACKGROUND OF THE INVENTION

The invention relates to cranes and particularly to cranes that are portable and folding for maximum portability and ease of storage. A large number of cranes and derricks have been provided which typically do not really fold. Instead, they may be disassembled to facilitate movement and storage. Such arrangements are not convenient to store or use. Examples of prior art includes the apparatus shown in the U.S. Pat. Nos. 494,473 and 4,508,233.

It is an object of the invention to provide apparatus which will fold very compactly.

It is another object of the invention is to provide apparatus which can be easily manufactured.

Another object of the invention is to provide apparatus which can be manufactured inexpensively.

SUMMARY OF THE INVENTION

It has now been found that these and other objects of the invention may be attained in a portable folding crane having an elongated base member which has first and second axial extremities and first and second elongated telescoping legs. Each of the legs has first and second axial extremities and each of the first axial extremities are pivotally connected poximate to respective axial extremities of the base member. A telescoping column member has first and second axial extremities. The first axial extremity of the telescoping column member is pivotally connected to the base member. A boom member has first and second axial extremities. The second axially extremity of the telescoping column member and the first axial extremity of the boom member being pivotally connected to the second axial extremity of the column member. The apparatus also includes means for urging the boom member to pivot with respect to the column member.

The column member may pivot in a first plane and the first and second legs may pivot in a second plane about the base member. A spanner member may engage the first and second legs at respective points and detachably engage the first and second legs at respective points spaced from the first axial extremities thereof. The column member may include a knee shaped portion at the first axial extremity and the column member may have the pivotable connection to the base member on the knee section carried on the knee section.

A tensioning member may extend from the second extremity of the column member to the base member. The tensioning member may include first and second rods. The rods may be elongated and each may have first and second axial extremities. The first and second rods may be connected by stop members respectively attached to axial extremities of the rods. The stop members may permit the first and second rods to move relative to each other until the stop members limit further relative axial movement. The stop members may be each fixed to one of the rods and each may have an opening therein which is dimensioned for free passage along the axial extent of the other rod and will not pass over the stop on the other rod.

BRIEF DESCRIPTION OF THE DRAWING

The invention will be better understood by reference to the accompanying drawings in which.

DESCRIPTION OF THE PREFERRED EMBODIMENT

Figure 1:
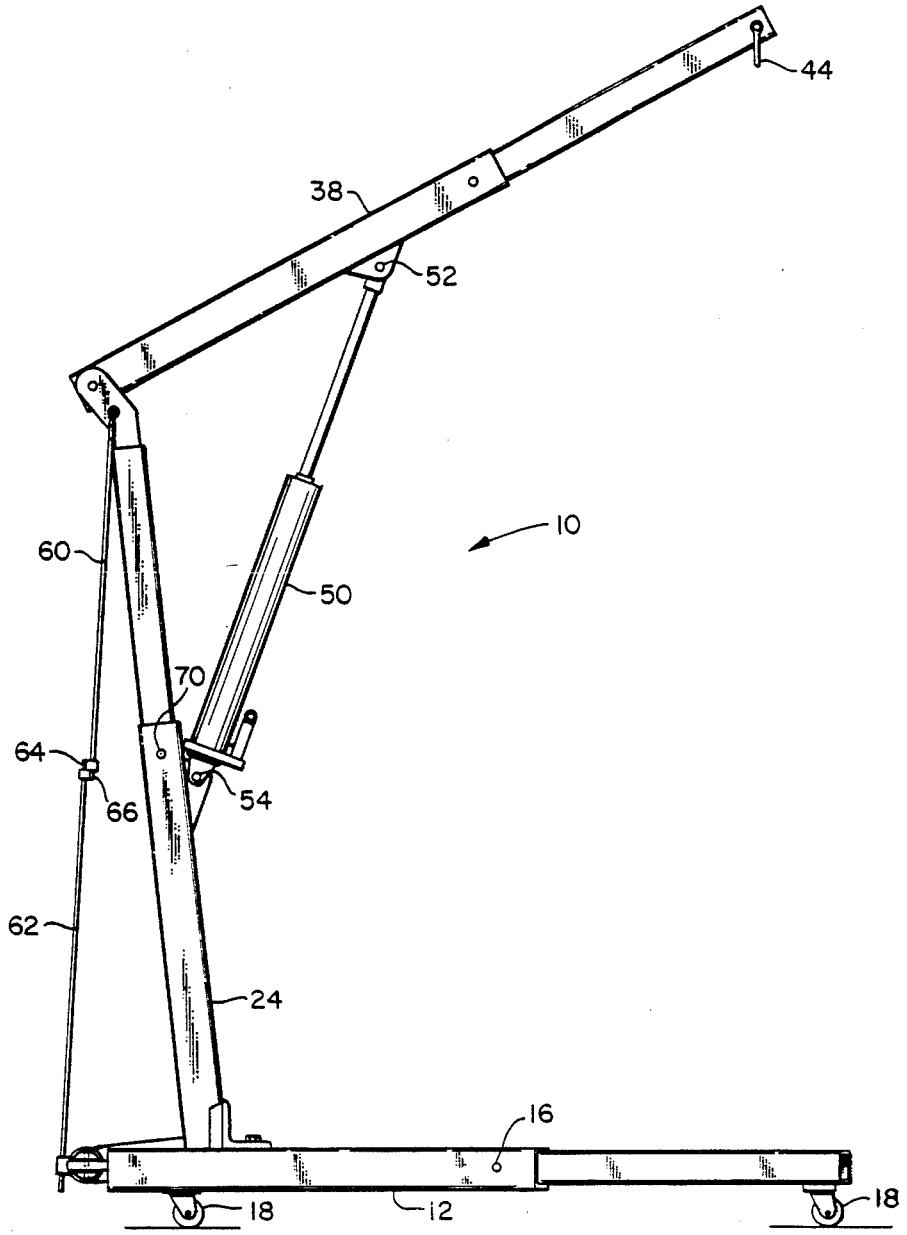
FIG. 1 is a side elevational view of the crane in accordance with the invention in its operating mode.
Figure 2:
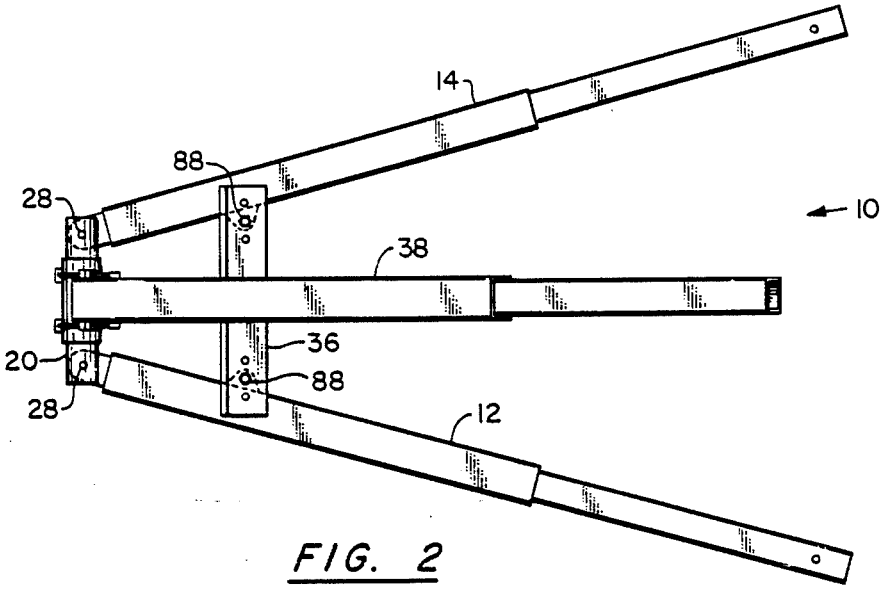
FIG. 2 is a top view of the crane as shown in FIG. 1.

Referring now to FIGS. 1–6 there is shown the folding portable crane 10 in accordance with one form of the invention. The apparatus includes first and second telescoping legs 12, 14. Each leg 12, 14 is manufactured of two concentric box shaped channels which are dimensioned and configured for relative sliding axial movement. Typically, the respective axial sections of each leg 12, 14 will be secured by a pin or ball detent such as 16. Casters 18, 19 are mounted on the lower surface of the first and second legs 12, 14 to allow ease of movement of the crane 10 as well as the crane when loaded with an object such as an automobile engine. Each leg member 12, 14 has a first axial extremity and a second axial extremity. As shown in FIGS. 1 and 2 the leg members 12, 14 are extended to their maximum length. The second axial extremities of the leg member 12, 14 as used herein refers to the free end of the leg members 12, 14 and the first axial extremities refers to the opposite end which is pivotally connected to a base member 20.

The pivotal connection between the base member 20 and the leg members 12, 14 allow relative movement in a first plane which will be understood to be generally horizontal.

The base member 20 is, in one form of the invention, a generally cylindrical tube, as best seen in FIG. 2, about which is pivoted a telescoping column member 24 which is also elongated and has first and second axial extremities. The first axial extremity is provided with a knee section 26 which engages the tube shaped base member 20 for relative pivotal movement. More specifically, the pivotal connection between the knee 26 and the base member 20 is best seen in FIG. 2 which best illustrates the concentric cylindrical sections which provide the necessary pivotal connection. FIG. 2 also illustrates the pin connections 28, 28 which respectively join the first axial extremities of the leg members 12, 14 to the base member 20.

An elongated spanner member 36, which is fabricated from an L-shaped channel, is detachably secured by bolts or pins 88,88 to both the first and second legs 12, 14 at points spaced from the first axial extremities of these legs.

Secured to the upper or second axial extremity of the telescoping column member 24, is a boom member 38 which is also telescoping in the same manner as the column 24 and the legs 12, 14. A pin connection 40 joins the boom member 38 to the column member 24. As in the leg members 12, 14, the boom member has a detent or pin 42 to secure the axial position of the sections of the boom member 38. A clevis 44 is secured by a pin 46 to the free end of the boom member 38.

A hydraulic cylinder 50 is secured by pins 52, 54 to the boom member 38 and the column member 24.

A tensioning member is provided to stabilize the position of the column member 24. In the preferred embodiment this tensioning member is a pair of rods 60, 62 as best seen in FIG. 1. These rods have respective stop members 66, 64 disposed at the respective ends of the rods. Each of the stop members has a hole (not shown) which allows free passage of the other rod but not passage over the other stop member. More particularly, the rod 60 has stop member 66 fixed to the end thereof which has an opening which allows the passage of the axial extent of the rod 62 but not the passage of the stop 64. Thus, the rods 60, 62 are free to move to the position shown in FIG. 1 when the column member 24 is fully extended and locked place by a pin, bolt or other latching device 70. The rod 60 is secured to the upper or second axial extremity of the column member 24. The rod 62 is secured to the base member 20. The boom member 38 is telescoped to its shortest possible length.

Figure 3:
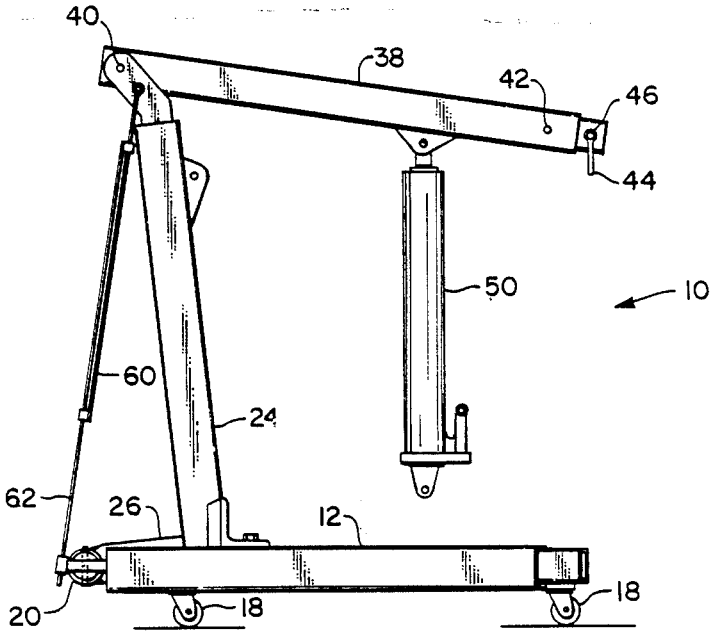
FIG. 3 is a view showing the first in a series of steps involved in the folding of the crane.

When the apparatus is to be folded, the column member 24 is telescoped to its shortest possible length as are the legs 12, 14 as shown in FIG. 3. The rods 60, 62 have moved to a side by side axially overlapping relationship as best shown in FIG. 3.

Figure 4:
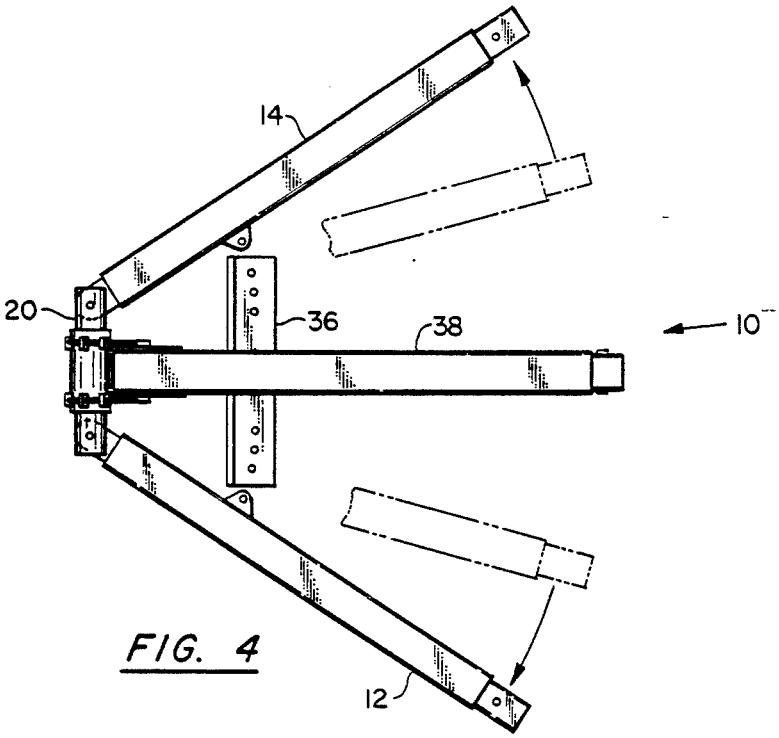
FIG. 4 is a top view of the crane as shown in FIG. 3.

Referring now to FIG. 4 there is shown a top view corresponding to FIG. 3 which illustrates the removal of the spanner member 36 by removal of the bolts or pins 88, 88, and the subsequent spreading of the legs 12, 14 by pivoting them about their respective pivot points on the base member 20.

Figure 5:
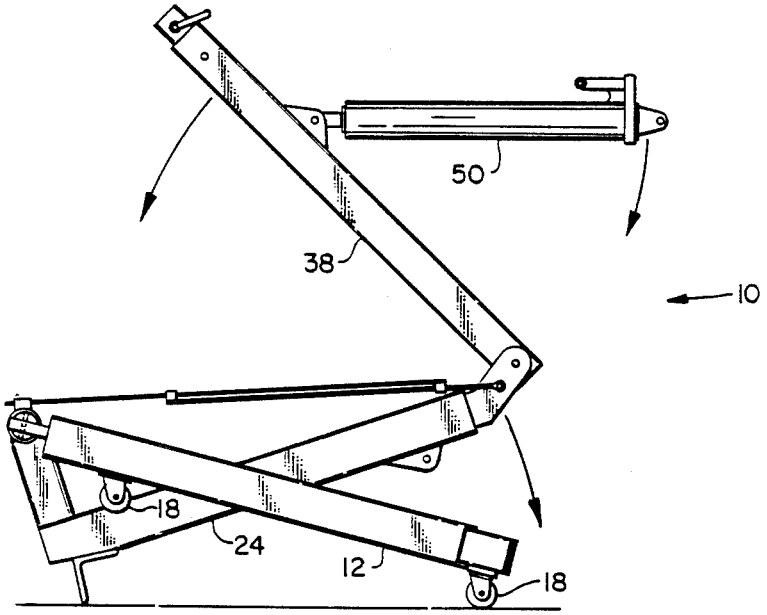
FIG. 5 is an elevational view showing a second step in the process of folding up the crane.
Figure 6:
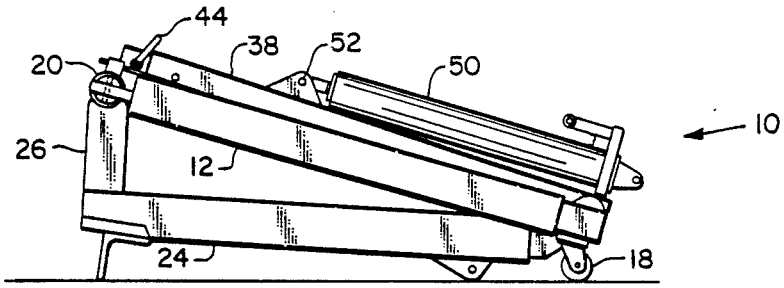
FIG. 6 is a final elevational view showing the crane fully folded.

Referring to FIG. 5 there is still shown still further step wherein the boom member 38 is folded toward a substantially parallel side by side relationship with the column member 24 as best seen in FIG. 6. Simultaneously, the hydraulic cylinder 50 is pivoted to substantially a parallel side by side relationship to the boom member 38. Simultaneously, the legs 12, 14 are also pivoted around the base member 20.

FIG. 6 illustrates the fully folded crane 10. It will be understood that the crane 10 may be easily moved when folded in this manner as well as stored. It will be further understood that the crane 10 may be stored either in the illustrated position or in an upright position wherein the apparatus is at a 90 degree angle with respect to the position shown in FIG. 6.

The invention has been described with reference to its illustrated preferred embodiment. Persons skilled in the art of cranes and the like may, upon exposure to the teachings herein, conceive other variations. Such variations are deemed to be encompassed by the disclosure, the invention being delimited only by the appended claims.

I claim:

1. A folding portable crane apparatus which comprises:

an elongated base member having first and second axial extremities;

first and second elongated telescoping legs, each of said legs having first and second axial extremities, each of said first axial extremities being pivotally connected proximate to respective axial extremities of said base member;

a telescoping column member having first and second axial extremities, said first axial extremity of said telescoping column member being pivotally connected to said base member;

a boom member having first and second axial extremities, said second axially extremity of said telescoping column member and said first axial extremity of said boom member being pivotally connected;

means for urging said boom member to pivot with respect to said column member;

said column member being pivotable in a first plane and said first and second legs being pivotable in a second plane about said base member;

said apparatus also including a spanner member engaging said first and second legs at respective points and detachably engaging said first and second legs at respective points spaced from said first axial extremities thereof;

said column member including an elongated member having first and second axial sections disposed in oblique relationship, said member being disposed at said first axial extremity and said column member and said base member are pivotally connected on said member;

said apparatus also including a tensioning member extending from said second extremity of said column member to said base member, said tensioning member including first and second rods.

2. The apparatus as described in claim 1 wherein:

said rods are elongated and each have first and second axial extremities, said first and second rods are connected by stop members respectively attached to axial extremities of said rods.

3. The apparatus as described in claim 2 wherein:

said stop members permit said first and second rods to move relative to each other until said stop members limit further relative axial movement.

4. The apparatus as described in claim 3 wherein:

said stop members are each fixed to one of said rods and each have an opening therein which is dimensioned for free passage along the axial extent of the other rod and will not pass over said stop on the other rod.

* * * * *